US009025636B2

(12) United States Patent
Chen et al.

(10) Patent No.: US 9,025,636 B2
(45) **Date of Patent: *May 5, 2015**

(54) ELECTROMAGNETIC INDUCTION MELTING FURNACE TO CONTROL AN AVERAGE NOMINAL DIAMETER OF THE $TiB_2$ CLUSTER OF THE AL-TI-B ALLOY

(75) Inventors: Xuemin Chen, Guangdong (CN); Qingdong Ye, Guangdong (CN); Jianguo Li, Guangdong (CN); Chaowen Liu, Guangdong (CN); Yueming Yu, Guangdong (CN)

(73) Assignee: Shenzhen Sunxing Light Alloys Materials Co., Ltd., Shenzhen, Guangdong (CN)

( * ) Notice: Subject to any disclaimer, the term of this patent is extended or adjusted under 35 U.S.C. 154(b) by 0 days.

This patent is subject to a terminal disclaimer.

(21) Appl. No.: 12/867,126

(22) PCT Filed: May 11, 2010

(86) PCT No.: PCT/CN2010/072589

§ 371 (c)(1),
(2), (4) Date: Aug. 11, 2010

(87) PCT Pub. No.: WO2011/022987

PCT Pub. Date: Mar. 3, 2011

(65) Prior Publication Data

US 2011/0164650 A1 Jul. 7, 2011

(30) Foreign Application Priority Data

Feb. 5, 2010 (CN) ..... 2010 1 0110166

(51) Int. Cl.

| | |
|---|---|
| ***H05B 6/06*** | (2006.01) |
| ***H05B 6/22*** | (2006.01) |
| ***H05B 6/36*** | (2006.01) |
| ***F27B 14/06*** | (2006.01) |
| ***F27D 99/00*** | (2010.01) |

(52) U.S. Cl.
CPC ..... *H05B 6/367* (2013.01); *F27B 14/061* (2013.01); *F27D 99/0006* (2013.01)

(58) Field of Classification Search
CPC ..... F27B 14/061; F27B 14/14; F27B 14/10; F27D 99/0006; H05B 6/24; H05B 6/44; H05B 6/34; H05B 6/36; H05B 6/32; H05B 6/067; H05B 6/367
USPC ..... 373/4, 6, 7, 144, 147, 150, 151, 152, 373/138, 146, 153, 139, 148; 219/656, 662, 219/671, 672, 661; 266/237; 75/10.14
See application file for complete search history.

(56) References Cited

U.S. PATENT DOCUMENTS 1,822,539 A * 9/1931 Northrup ..... 373/146
4,874,916 A * 10/1989 Burke ..... 219/671

(Continued)

*Primary Examiner* — Quang Van
*Assistant Examiner* — Hung D Nguyen
(74) *Attorney, Agent, or Firm* — Jackson IPG PLLC; Demian K. Jackson

(57) ABSTRACT

An electromagnetic induction melting furnace to control an average nominal diameter of the $TiB_2$ cluster of the Al—Ti—B alloy includes a main body containing the melted alloy; and a multi-layer coil disposed on the main body, wherein a frequency of the alternative current of each coil of the multi-layer coil is different, and the alloy is heated by inducing a magnetic field generated by the alternative currents. The selection of the frequency and the changeable magnetic field may reduce the cohesion force between the $TiB_2$ grains of the Al—Ti—B alloy to control the average nominal diameter of the $TiB_2$ cluster.

5 Claims, 3 Drawing Sheets

(56) References Cited

U.S. PATENT DOCUMENTS 5,109,389 A * 4/1992 Stenzel ..... 373/156
5,940,427 A * 8/1999 Hurtgen et al. ..... 373/150
6,121,592 A * 9/2000 Fishman et al. ..... 219/661
6,476,285 B1 * 11/2002 Kobayashi et al. ..... 588/15
6,993,061 B2 * 1/2006 Roach et al. ..... 373/146

* cited by examiner

ELECTROMAGNETIC INDUCTION MELTING FURNACE TO CONTROL AN AVERAGE NOMINAL DIAMETER OF THE $TiB_2$ CLUSTER OF THE AL-TI-B ALLOY

BACKGROUND

This invention is related to a melting device of metallurgical industry, especially to an electromagnetic induction melting furnace to control an average nominal diameter of the $TiB_2$ cluster of the Al—Ti—B alloy.

Al—Ti—B alloy is a kind of aluminum alloy and crystal nuclei of master alloy which is worldwide used in aluminum manufacture. The aluminum or aluminum alloy mixed with the Al—Ti—B alloy may have solidified grains refined to improve the characters of the yield strength, the plasticity and calenderability, and ductile-brittle transition temperature. By now, during the world, an effective method to manufacture the Al—Ti—B alloy is the thermal reduction reaction using the potassium fluotitanate ($K_2TiF_6$) and potassium fluoborate ($KBF_4$) and Aluminum melt (according to the Al—Ti alloy, use the thermal reduction reaction with the potassium fluotitanate ($K_2TiF_6$) and carbon and Aluminum melt). This method may produce a lot of $TiB_2$ to be the grain core of the refined aluminum or aluminum alloy. According to the Al—Ti—B alloy, the $TiB_2$ exists by a form of cluster, and the more refined its own average nominal diameter is, the greater the solidified refined power of the aluminum or aluminum alloy will be. However, according to the present art, the thermal reduction reaction is processed in a pot melting furnace or an electromagnetic induction melting furnace with a single frequency (power frequency). The produced $TiB_2$ cluster of the Al—Ti—B alloy has a greater average nominal diameter which can increase the size of the solidified grain of the aluminum or aluminum alloy refined by the $TiB_2$ cluster of the Al—Ti—B alloy.

BRIEF SUMMARY

The present invention is directed to provide a electromagnetic induction melting furnace which can control an average nominal diameter of the $TiB_2$ cluster.

According to an embodiment of the present invention, an electromagnetic induction melting furnace to control an average nominal diameter of the $TiB_2$ cluster of the Al—Ti—B alloy includes a main body containing the melted alloy; and a multi-layer coil disposed on the main body, wherein a frequency of the alternative current of each coil of the multi-layer coil is different, and the alloy is heated by inducing a magnetic field generated by the alternative currents.

According to an embodiment of the present invention, the multi-layer coil includes a first layer coil with a first frequency, a second layer coil with a second frequency, and a third layer coil with a third frequency.

According to an embodiment of the present invention, the first layer coil, the second layer coil and the third layer coil are disposed in sequence from the outside to the inside of the side wall of the main body, the third layer coil is closest to the outside surface of the side wall and the second layer coil has a diameter larger than that of the third layer coil and similarly the first coil has a diameter larger than that of the second layer coil.

According to an embodiment of the present invention, there is a distance between the adjacent layers in horizontal direction and the distance can be in a range of 5-15 cm.

According to an embodiment of the present invention, there is an isolation layer disposed between the adjacent coils.

According to an embodiment of the present invention, the first frequency is 50 Hz, the second frequency may be adjusted in a range of 500-1200 Hz, and the third frequency may be adjusted in a range of 1500-2500 Hz.

According to an embodiment of the present invention, further comprises a first compensation capacitor disposed on the first layer coil, a second compensation capacitor disposed on the second layer coil, and a third compensation capacitor disposed on the third layer coil.

According to an embodiment of the present invention, the capacitance of the first compensation capacitor can be adjusted in a range of 40-120 μF, the capacitance of the second compensation capacitor can be adjusted in a range of 400-1000 μF, the capacitance of the third compensation capacitor can be adjusted in a range of 800-1800 μF.

further comprises a coil driving control device whose output separately connects to the first layer coil, the second layer coil, and the third layer coil, and the coil driving control device and the coils are disposed in a same control unit.

According to the embodiments of the invention, the selection of the frequency and the changeable magnetic field may reduce the cohesion force between the $TiB_2$ grains of the Al—Ti—B alloy to control the average nominal diameter of the TiB2 cluster.

BRIEF DESCRIPTION OF THE DRAWINGS

These and other features and advantages of the various embodiments disclosed herein will be better understood with respect to the following description and drawings, in which like numbers refer to like parts throughout, and in which.

DETAILED DESCRIPTION

Figure 1:
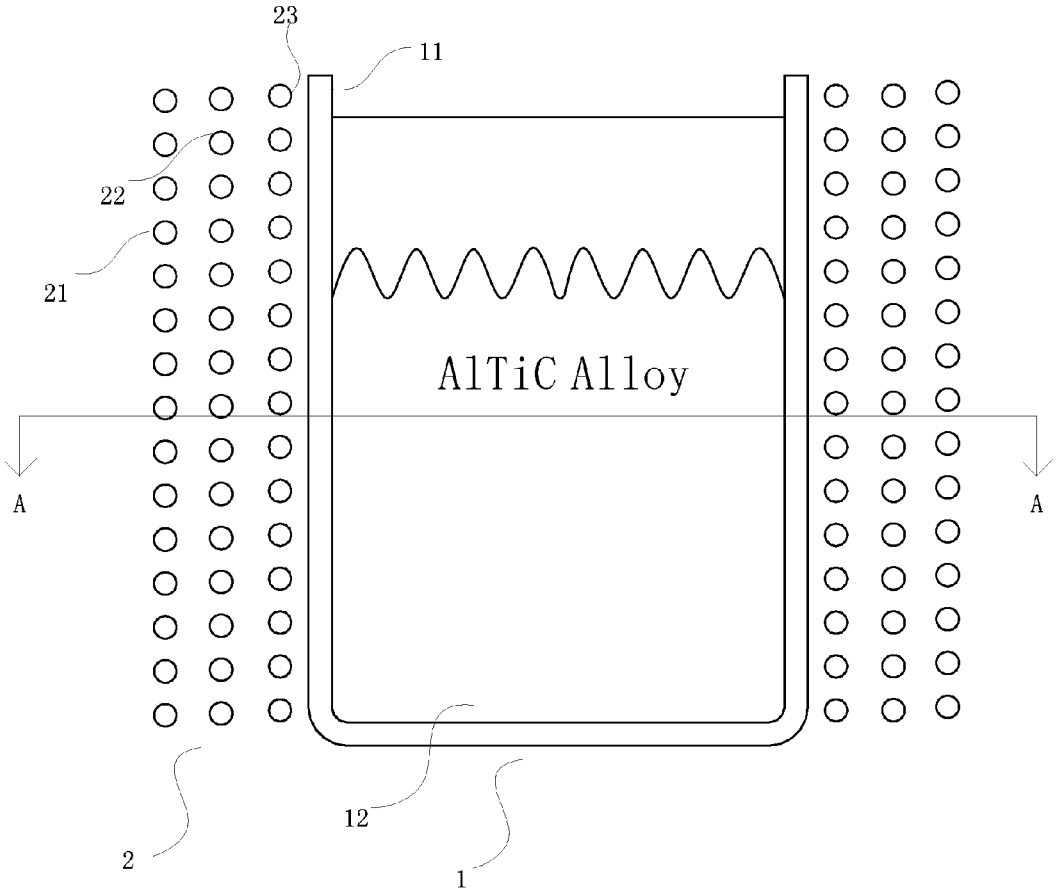
FIG. 1 is a cross-sectional schematic view of an electromagnetic induction melting furnace to control an average nominal diameter of the $TiB_2$ cluster of the Al—Ti—B alloy according to an embodiment of present invention.
Figure 2:
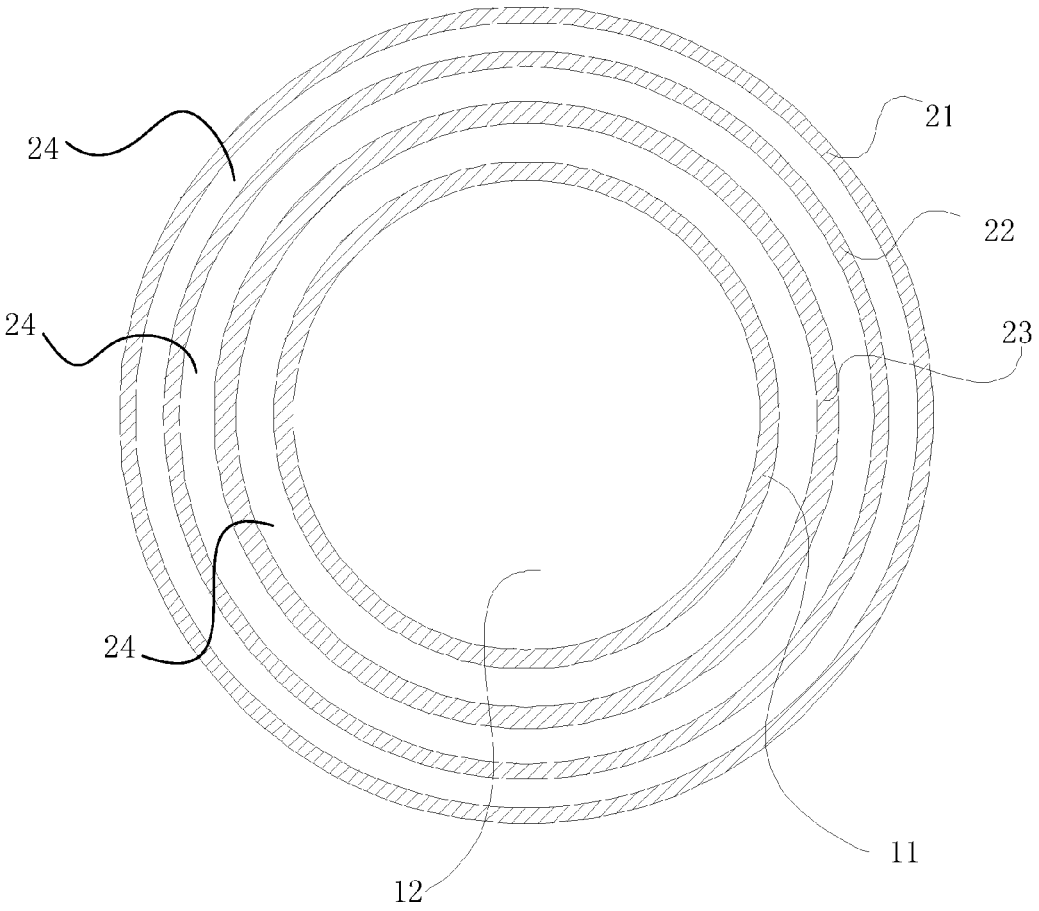
FIG. 2 is a cross-sectional view along A-A of FIG. 1.

As shown in FIG. 1 and FIG. 2, an electromagnetic induction melting furnace to control an average nominal diameter of the $TiB_2$ cluster of the Al—Ti—B alloy according to an embodiment of the invention is disclosed. The electromagnetic induction melting furnace includes a main body 1 and a coil 2 disposed on the main body 1. The main body 1 includes a side wall 11 and a space 12 formed by the side wall 11 to contain the metal or alloy. The coil 2 is disposed outside and surrounding the side wall along the axis of the main body 1 with different diameters. The coil 2 is controlled and driven by a control device (not shown), and an alternative current generates a changeable magnetic field in the space 12. The metal or alloy of the main body 1 induces the changeable magnetic field and cuts the magnetic field lines to generate an eddy current on the surface of the metal or alloy. Because the metal or alloy has a certain resistance, and the resistance may generate a lot of heat to melt the metal or alloy. The melting metal or alloy may generate a movement by the induced force of the changeable magnetic field. When the movement is great enough, the surface of the melting metal or alloy may form peaks and valleys.

According to this embodiment of FIG. 1, the coil 2 includes three single layers coil: a first layer coil 21, a second layer coil 22 and a third layer coil 23. Each current frequency transmitted to the coil by the control device is different separately. Of course, the quantity of the coil may be two or four or other else. The difference of the coil quantity leads to the difference of the magnetic field.

The coil 2 includes the first layer coil 21, the second layer coil 22 and the third layer coil 23 and accordingly the current frequency is a first frequency, a second frequency, and a third frequency. The first frequency is 50 Hz, the second frequency is 1000 Hz, and the third frequency is 2100 Hz. According to other embodiments, the second frequency may be adjusted in a range of 500-1200 Hz, and the third frequency may be adjusted in a range of 1500-2500 Hz.

The selection of the frequency and the changeable magnetic field may reduce the cohesion force between the $TiB_2$ grains of the Al—Ti—B alloy to control the average nominal diameter of the $TiB_2$ cluster. The average nominal diameter of the $TiB_2$ cluster may be reduced from 4-5 μm to into 1.8-2 μm.

According to the electromagnetic induction theory, the magnetic field strength generated by the coil is determined by the shape of the coil and the current frequency. Generally, the higher the current frequency is, the more intensive the magnetic field lines are, also the more powerful the magnetic force is. For the power frequency 50 Hz, the magnetic force mostly focuses on the center position of the coil. However for the frequency of 1000 Hz, the magnetic force is closer to those positions which are disposed regularly of the central axis of the coil, not the center position of the coil. For the frequency 2100 Hz, the magnetic force is similar to that of the frequency of 1000 Hz, but much closer to the coil. The magnetic force focuses on a certain range not a point. So, the magnetic force can reach any position of the main body 1 by the three different current frequencies. The average nominal diameter of the $TiB_2$ cluster can be controlled by the magnetic force to be in a normal distribution with a small central size.

As shown in FIG. 1 and FIG. 2, the first layer coil 21, the second layer coil 22 and the third layer coil 23 are disposed in sequence from the outside to the inside of the side wall 11. The third layer coil 23 is closest to the outside of the side wall 11. The second layer coil 22 has a diameter larger than that of the third layer coil 23 and similarly the first coil 21 has a diameter larger than that of the second layer coil 22.

The first layer coil 21, the second layer coil 22 and the third layer coil 23 are disposed on the main body 1, and each coil has an isolation layer surrounding the line of the coil. There is a distance of 8 cm between the adjacent layers in horizontal direction according to this embodiment and the distance can be 5-15 cm according to other embodiments. Concretely speaking, the adjustment of the distance can change the melt alloys position in the main body 1 which can make the magnetic force applied on the melt alloys evenly. Thus, the metal or alloy in the space 12 can be heated more effectively and the electromagnetic interference can be reduced.

According to this embodiment, the main body 1 is made of the material of SiC.

The electromagnetic induction melting furnace further includes a first compensation capacitor disposed on the first layer coil 21, a second compensation capacitor disposed on the second layer coil 22, and a third compensation capacitor disposed on the third layer coil 23. The capacitance of the first compensation capacitor is 90 μF, the capacitance of the second compensation capacitor is 720 μF, and the capacitance of the third compensation capacitor is 1200 μF.

According to other embodiments, the capacitance of the first compensation capacitor can be adjusted in a range of 40-120 μF, the capacitance of the second compensation capacitor can be adjusted in a range of 400-1000 μF, the capacitance of the third compensation capacitor can be adjusted in a range of 800-1800 μF. The compensation capacitors can reduce the wave shape distortion and the pollution of power source, and improve the power factor.

According to this embodiment, the electromagnetic induction melting furnace further includes a control unit and a coil driving control device disposed in the control unit connecting to the first layer coil 21, the second layer coil 22, and the third layer coil 23. The third coils can enhance the magnetic field strength of the space 12 and the alternative frequency, and control the average nominal diameter of the $TiB_2$ cluster. Each coil of the third layer coils can work in turn or two coils of the third layer coils can work in turns.

Figure 3:
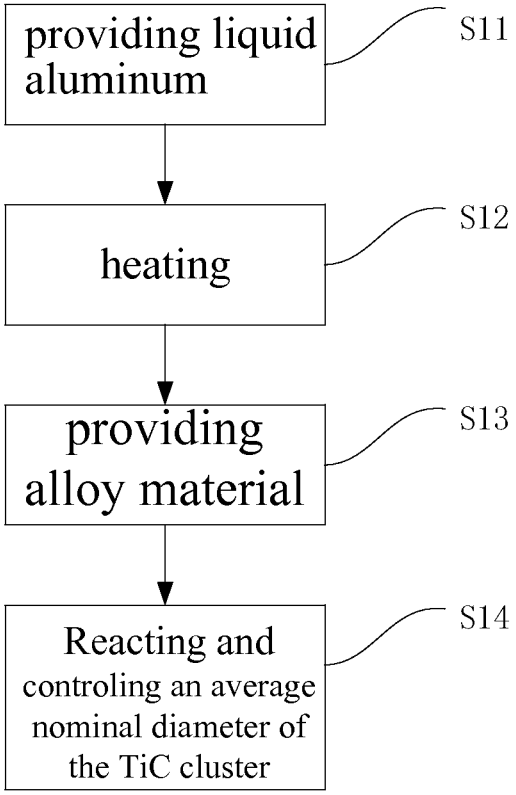
FIG. 3 is a process view of the Al—Ti—B melting in the electromagnetic induction melting furnace.

As shown in FIG. 3, a manufacture process is provided, which includes the following steps:

S11: providing melt aluminum: put the aluminum into an electromagnetic induction melting furnace. According to this embodiment, the aluminum may be melted by other devices and putted into a space of the main body 1, which can save the time of melting aluminum. Of course, solid aluminum can also be used which need a further step of melting.

S12: heating the liquid melting aluminum in a normal temperature range using the electromagnetic induction melting furnace.

S13: adding alloy materials: add potassium fluotitanate ($K_2TiF_6$) and potassium fluoborate ($KBF_4$) powder and mix the alloy materials and the liquid melting aluminum and keep them in the electromagnetic induction melting furnace for a while.

S14: control an average nominal diameter of the $TiB_2$ cluster. A reaction between the alloy materials and the liquid melting aluminum takes place to get liquid alloys. The longitudinal section of the liquid alloys forms several peaks and valleys by the induced force of the changeable magnetic field in the electromagnetic induction melting furnace. The magnetic force of the three coils may make the alloy materials and the liquid melting aluminum be mixed sufficiently and control an average nominal diameter of the $TiB_2$ cluster. Particularly, the higher current frequency of the coil generates a greater magnetic force closer to the coil and a greater control force to make the average nominal diameter of the $TiB_2$ cluster smaller. The average nominal diameter of the $TiB_2$ cluster can be 2 μm by using the electromagnetic induction melting furnace and the grain refine force to the aluminum or aluminum alloy can be increased greatly.

Following the step S14, the Al—Ti—B can be used in other process, such manufacturing Al—Ti—B alloy line or being added into other aluminum or aluminum alloy.

According to the Al—Ti—C alloy, the process is similar to the above process except of using potassium fluotitanate ($K_2TiF_6$) and difference of an average nominal diameter of the final TiC cluster.

What is claimed is:

1. An electromagnetic induction melting furnace, comprising:

a main body containing melted alloy and including a side wall; and a multi-layer coil, each layer of coil operating at a different frequency and of a different diameter, the multi-layer coil disposed outside of and on a main axis of the side wall of the main body and comprising:

a first layer coil of a greatest diameter with a first, lowest frequency alternating current and surrounding the side wall in an outermost arrangement wherein the first frequency alternating current induces magnetic fields most outwardly in the main body, a second layer coil of an intermediate diameter with a second, intermediate frequency alternating current and surrounding the side wall in an intermediate arrangement, and a third layer coil of a smallest diameter with a third, highest frequency alternating current and surrounding the side wall in an innermost arrangement wherein the third frequency alternating current induces magnetic fields most centrally in the main body, wherein there is a distance in a range of 5-15 cm between adjacent layers in a horizontal direction and such that the alloy is heated by the different magnetic fields generated by the different frequency alternating currents.

2. The electromagnetic induction melting furnace of claim 1, wherein the second frequency alternating current induces magnetic fields intermediate the magnetic fields induced by the first and third layer coils.

3. The electromagnetic induction melting furnace of claim 1, wherein each of the first, second, and third layer coils works in turns or wherein pairs of the first, second, and third layer coils work in turns.

4. The electromagnetic induction melting furnace of claim 1, wherein the frequency of alternating current of at least one of the coils is adjustable.

5. The electromagnetic induction melting furnace of claim 4, wherein the frequency of alternating current of the second coil is adjustable in a range of 500-1200 Hz and the frequency of alternating current of the third coil is adjustable in a range of 1500-2500 Hz.

* * * * *